US010449761B2

(12) United States Patent
Misawa et al.

(10) Patent No.: US 10,449,761 B2
(45) Date of Patent: Oct. 22, 2019

(54) LIQUID EJECTION DEVICE AND INKJET PRINTER INCLUDING THE SAME

(71) Applicant: Roland DG Corporation, Hamamatsu-shi, Shizuoka (JP)

(72) Inventors: Keisuke Misawa, Hamamatsu (JP); Kenji Kazaoka, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/878,438

(22) Filed: Jan. 24, 2018

(65) Prior Publication Data

US 2018/0222185 A1 Aug. 9, 2018

(30) Foreign Application Priority Data

Feb. 8, 2017 (JP) ..... 2017-021049

(51) Int. Cl.
*B41J 2/045* (2006.01)

(52) U.S. Cl.
CPC ..... *B41J 2/04588* (2013.01); *B41J 2/04516* (2013.01); *B41J 2/04573* (2013.01); *B41J 2/04581* (2013.01); *B41J 2/04593* (2013.01)

(58) Field of Classification Search
CPC ..... B41J 2/04581; B41J 2/04588; B41J 2/04593; B41J 2/04541; B41J 2/04573; B41J 2/04596
See application file for complete search history.

(56) References Cited

U.S. PATENT DOCUMENTS 6,151,050 A * 11/2000 Hosono ..... B41J 2/04541 347/10
6,290,315 B1 * 9/2001 Sayama ..... B41J 2/04581 347/10
6,364,444 B1 * 4/2002 Ota ..... B41J 2/04541 347/10
9,463,619 B2 * 10/2016 Mitsuki ..... B41J 2/04558
2004/0079768 A1 * 4/2004 Kiguchi ..... B41J 2/04506 222/420
2014/0240384 A1 8/2014 Yokomaku
2016/0347058 A1 * 12/2016 Suzuki ..... B41J 2/04588

FOREIGN PATENT DOCUMENTS

JP 10-81012 A 3/1998
JP 2014-162221 A 9/2014

* cited by examiner

*Primary Examiner* — John Zimmermann
(74) *Attorney, Agent, or Firm* — Keating & Bennett, LLP

(57) ABSTRACT

A driving signal generation circuit generates a main driving signal including, in each of driving periods, at least a first sub driving signal including a first driving pulse and a second driving pulse, and a second sub driving signal including a third driving pulse and provided before the first sub driving signal. A driving signal supply circuit includes a first dot generator supplying the first sub driving signal but not supplying the second sub driving signal to an actuator coupled with a vibration plate defining a portion of a pressure chamber, and a second dot generator supplying the first sub driving signal and the second sub driving signal to the actuator.

6 Claims, 6 Drawing Sheets

LIQUID EJECTION DEVICE AND INKJET PRINTER INCLUDING THE SAME

CROSS REFERENCE TO RELATED APPLICATION

This application claims the benefit of priority to Japanese Patent Application No. 2017-021049 filed on Feb. 8, 2017. The entire contents of this application are hereby incorporated herein by reference.

BACKGROUND OF THE INVENTION

1. Field of the Invention

The present invention relates to a liquid ejection device and an inkjet printer including the same.

2. Description of the Related Art

Conventionally, a liquid ejection device is known including a pressure chamber storing a liquid, a vibration plate defining a portion of the pressure chamber, an actuator coupled with the vibration plate, a plurality of nozzles in communication with the pressure chamber, and a controller supplying a driving signal to the actuator to drive the actuator. Such a liquid ejection device is provided in, for example, an inkjet printer ejecting ink as a liquid.

An inkjet printer including the above-described liquid ejection device operates as follows. When the controller supplies a driving pulse signal (hereinafter, referred to as a "driving pulse") to the actuator, the actuator is deformed, and in accordance with this, the vibration plate is deformed. This increases or decreases the capacity of the pressure chamber, and thus the pressure of the ink in the pressure chamber is changed. Along with the change in the pressure, the ink is ejected from each of the nozzles. The ejected ink jumps as an ink drop and arrives at a recording medium such as a recording paper sheet or the like. As a result, one dot is formed on the recording paper sheet. A large number of such dots are formed on the recording paper sheet, and thus an image or the like is formed.

An adjustment on the size of the dots (e.g., diameter) allows a high quality image to be formed on the recording paper sheet. However, in the inkjet printer as described above, there is a limit on the amount of the ink drops that may be ejected stably by one driving pulse. It is difficult to form dots of different sizes with one driving pulse. For example, Japanese Laid-Open Patent Publication No. H10-81012 discloses a method for adjusting the size of the dots by a multi-dot system. According to the multi-dot system, a driving signal including a plurality of driving pulses is generated within a time period preset for forming one dot on the recording medium (hereinafter, such a present time period will be referred to as a "driving period"), and one or at least two driving pulses included in the driving signal are selectively supplied to the actuator. For example, in order to form a relatively large dot, at least two ink drops are ejected in a time-series manner within one driving period and are merged before arriving at the recording medium.

Usually, a liquid ejection device includes a plurality of nozzles and a plurality of pressure chambers respectively in communication with the plurality of nozzles. When a liquid drop is ejected from one nozzle, a pressure chamber adjacent to the pressure chamber in communication with the one nozzle may be subjected to a pressure change caused by the liquid drop ejection. Japanese Laid-Open Patent Publication No. H10-81012 discloses a driving signal usable to eject a plurality of liquid drops of different sizes. When a liquid drop is ejected from a specific nozzle by use of such a driving signal, the pressure change that may be caused to the specific nozzle varies in accordance with which size of dot has been ejected (namely, in accordance with the liquid drop amount that has been ejected) from a nozzle adjacent to the specific nozzle. As a result, the properties of the liquid drop ejected from the specific nozzle may be changed.

SUMMARY OF THE INVENTION

Preferred embodiments of the present invention provide liquid ejection devices ejecting a desirable size of liquid drops stably, and inkjet printers including such liquid ejection devices.

A liquid ejection device according to a preferred embodiment of the present invention includes a liquid ejection head that ejects a liquid; and a controller that controls the liquid ejection head. The liquid ejection head includes a case that includes a pressure chamber provided therein, the pressure chamber storing a liquid; a vibration plate provided in the case, the vibration plate defining a portion of the pressure chamber; an actuator coupled with the vibration plate, the actuator being deformed when supplied with an electric signal; and a nozzle provided in the case, the nozzle being in communication with the pressure chamber. The controller includes a driving signal generation circuit that generates a main driving signal that includes, in each of driving periods, at least a first sub driving signal and a second sub driving signal, the first sub driving signal including one or at least two driving pulses, and the second sub driving signal including one or at least two driving pulses and provided before the first sub driving signal; and a driving signal supply circuit that supplies the actuator with a portion of, or the entirety of, the main driving signal generated by the driving signal generation circuit. The driving signal supply circuit includes a first dot generator that supplies the actuator with the first sub driving signal but does not supply the actuator with the second sub driving signal; and a second dot generator that supplies the actuator with the first sub driving signal and the second sub driving signal.

A liquid ejection device according to a preferred embodiment of the present invention uses the first sub driving signal of the main driving signal commonly to form the first dot and to form the second dot. Since the second sub driving signal is provided before the first sub driving signal, the driving pulse in a final portion of the first sub driving signal to be supplied to each of the actuators is commonly used to form the first dot and to form the second dot. Therefore, regardless of which size of dot is formed by the adjacent nozzle, the driving timing of the final driving pulse of the first sub driving signal is the same among the nozzles. As a result, regardless of the size of the dot formed by the nozzles, a constant pressure change is caused in the pressure chamber. Therefore, the nozzle characteristics are prevented from being varied among the nozzles, and a desired size of liquid drop is ejected stably from each of the nozzles.

Preferred embodiments of the present invention provide liquid ejection devices ejecting a desirable size of liquid drops stably, and inkjet printers including such liquid ejection devices.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of liquid ejection devices and inkjet printers including the same according to the present invention will be described with reference to the drawings. The preferred embodiments described below are not intended to specifically limit the present invention. Components and portions that have the same functions will bear the same reference signs, and overlapping descriptions will be omitted or simplified.

Figure 1:
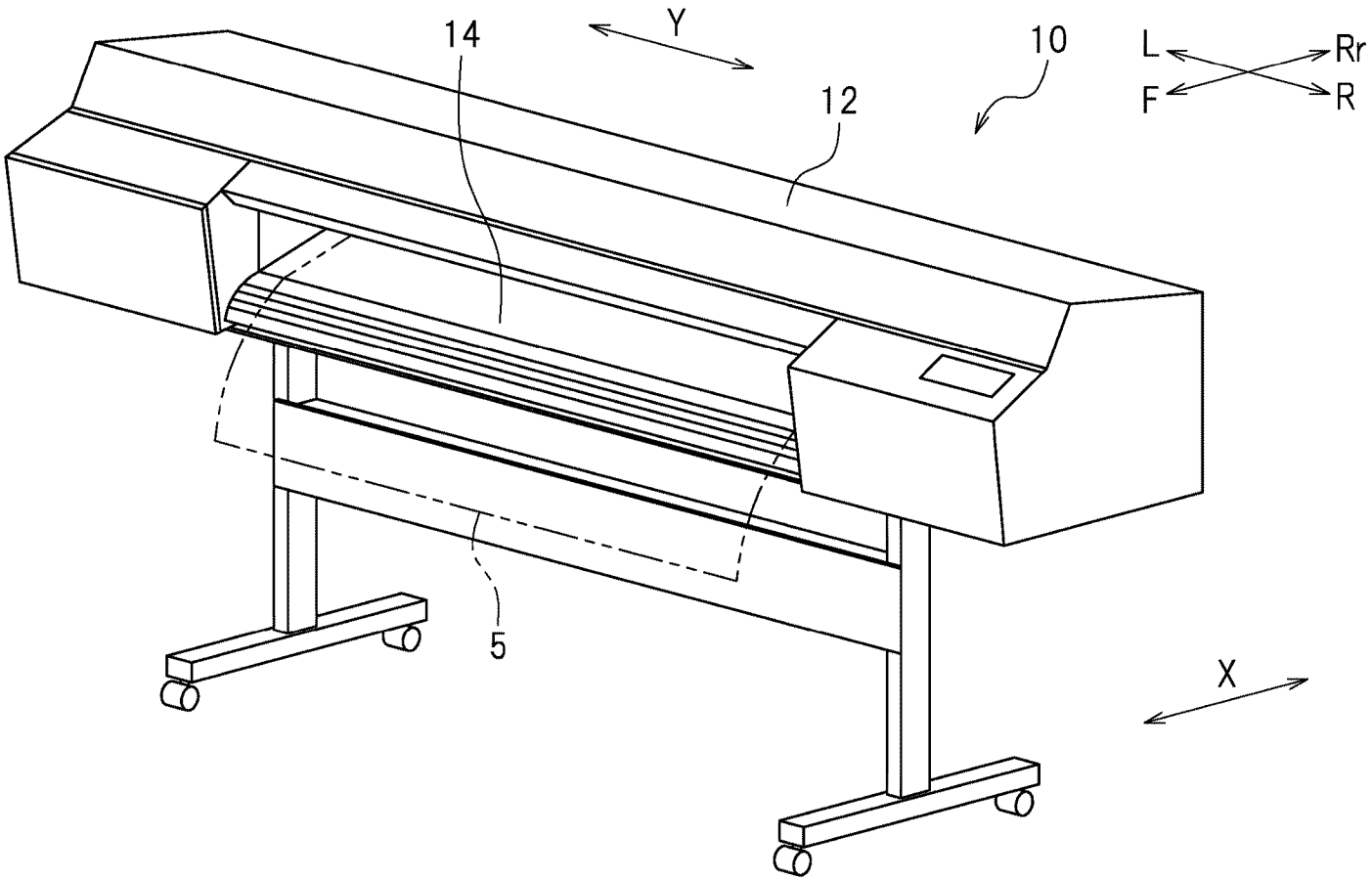
FIG. 1 is a perspective view of an inkjet printer according to a preferred embodiment of the present invention.
Figure 2:
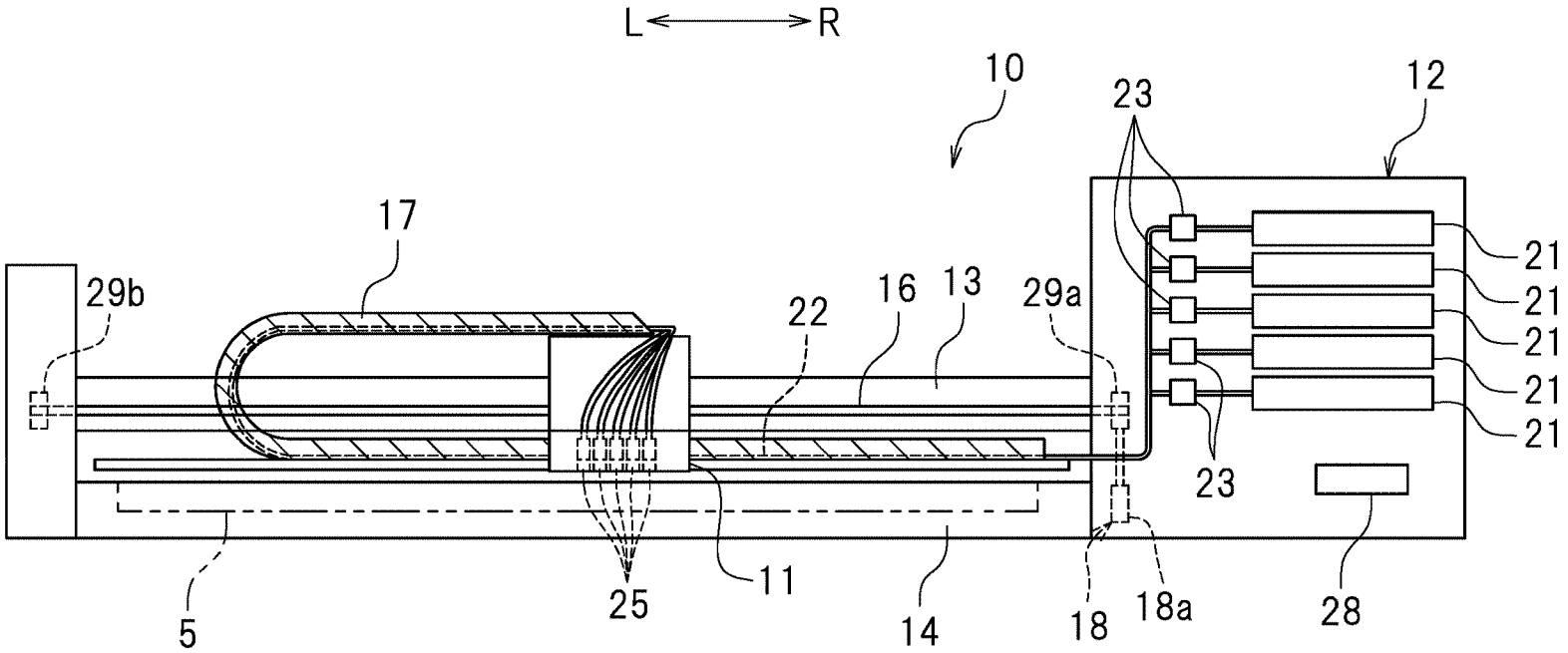
FIG. 2 is a partial front view of the inkjet printer according to a preferred embodiment of the present invention.

FIG. 1 is a perspective view of an inkjet printer 10 according to a preferred embodiment of the present invention. FIG. 2 is a partial front view of the inkjet printer 10. In FIG. 1 and FIG. 2, letters L and R respectively refer to "left" and "right". Letters F and Rr respectively refer to "front" and "rear". An ejection head 25 described below (see FIG. 2) is movable leftward and rightward. A recording paper sheet 5 is transportable forward and rearward. In this preferred embodiment, the direction in which the ejection head 25 is movable is referred to as a "main scanning direction Y", and the direction in which the recording paper sheet 5 is transportable is referred to as a "sub scanning direction X". In this example, the main scanning direction Y corresponds to a left-right direction, and the sub scanning direction X corresponds to a front-rear direction. The main scanning direction Y and the sub scanning direction X are perpendicular to each other. These directions are merely defined for the sake of convenience, and do not limit the manner of installation of the inkjet printer 10 in any way.

The inkjet printer 10 is to perform printing on the recording paper sheet 5. The recording paper sheet 5 is an example of recording medium, and an example of a target toward which ink is ejected. The "recording medium" encompasses recording mediums formed of paper including plain paper and the like, resin materials including polyvinyl chloride (PVC), polyester and the like, and various other materials including aluminum, iron, wood and the like.

As shown in FIG. 2, the inkjet printer 10 includes a casing 12 and a guide rail 13 located in the casing 12. The guide rail 13 extends in the left-right direction. The guide rail 13 is in engagement with a carriage 11 provided with a plurality of the ejection heads 25 ejecting ink. The carriage 11 is movable reciprocally in the left-right direction (i.e., main scanning direction Y) along the guide rail 13 by a carriage moving mechanism 18. The carriage moving mechanism 18 includes pulleys 29*b* and 29*a* provided at a left end and a right end of the guide rail 13. The pulley 29*a* is coupled with a carriage motor 18*a*. The carriage motor 18*a* may be coupled with the pulley 29*b*. The pulley 29*a* is drivable by the carriage motor 18*a*. An endless belt 16 is wrapped around the pulleys 29*a* and 29*b*. The carriage 11 is secured to the belt 16. When the pulleys 29*a* and 29*b* are rotated and thus the belt 16 runs, the carriage 11 moves in the left-right direction.

The inkjet printer 10 preferably is a large-scale inkjet printer, and is preferably larger than, for example, a table-top printer for home use. From the point of view of improving the throughput, the scanning rate of the carriage 11 may be set to be relatively high although the scanning rate is set also in consideration of resolution. For example, the scanning rate may be set to about 1300 mm/s to about 1400 mm/s at the driving frequency of about 16 kHz.

The recording paper sheet 5 is transported in a paper feeding direction by a paper feeder (not shown). In this example, the paper feeding direction is the front-rear direction (sub scanning direction X). In the casing 12, a platen 14, on which the recording paper sheet 5 is to be placed, is provided. The platen 14 is provided with a grit roller (not shown). Above the grit roller, a pinch roller (not shown) is provided. The grit roller is coupled with a feed motor (not shown). The grit roller is drivable to rotate by the feed motor. When the grit roller is rotated in a state where the recording paper sheet 5 is held between the grit roller and the pinch roller, the recording paper sheet 5 is transported in the front-rear direction.

The inkjet printer 10 includes a plurality of ink cartridges 21. The ink cartridges 21 respectively store ink of different colors. For example, the inkjet printer 10 includes five ink cartridges 21 respectively storing cyan ink, magenta ink, yellow ink, black ink and white ink.

The ejection heads 25 are respectively provided for inks of different colors. The ejection head 25 and the ink cartridge 21 for each of the colors are connected with each other via an ink supply path 22. The ink supply path 22 is an ink flow path usable to supply the ink from the ink cartridge 21 to the ejection head 25. The ink supply path 22 is, for example, a flexible tube. A supply pump 23 is provided on the ink supply path 22. The supply pump 23 is not absolutely necessary, and may be omitted. A portion of the ink supply path 22 is covered with a cable protection and guide device 17.

Figure 3:
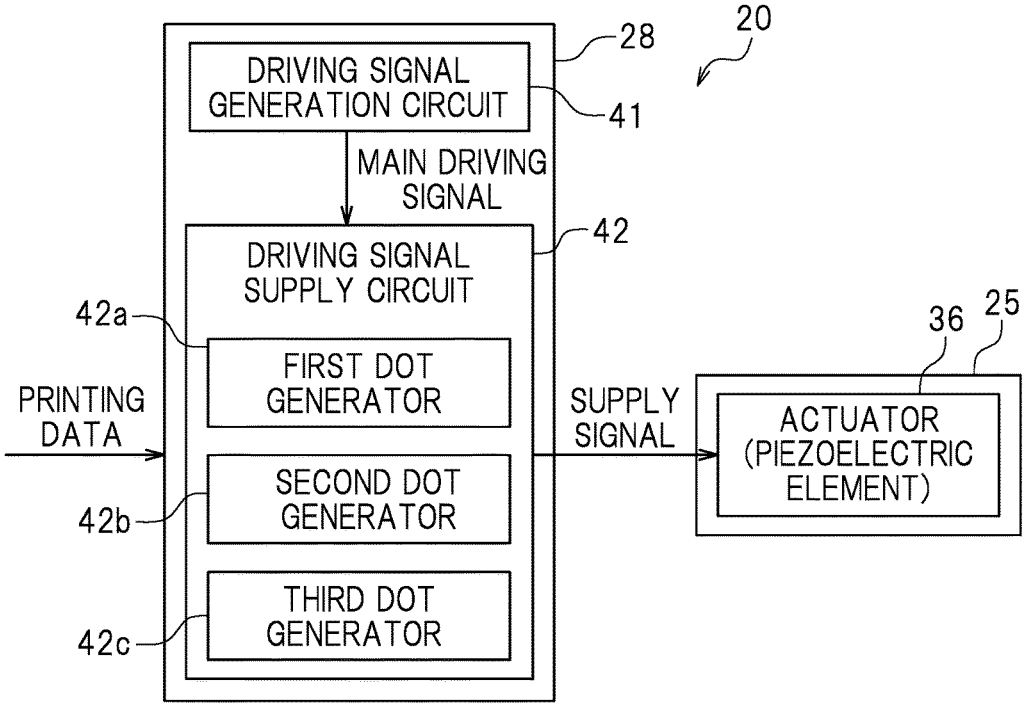
FIG. 3 is a block diagram showing a structure of a liquid ejection device according to a preferred embodiment of the present invention.

As shown in FIG. 3, the inkjet printer 10 includes a liquid ejection device 20. The liquid ejection device 20 includes the ejection heads 25 and a controller 28 to control an operation of the ejection heads 25.

The ejection head 25 ejects a liquid (typically, ink). The ejection head 25 is an example of liquid ejection head. The ejection head 25 ejects ink toward the recording paper sheet 5 to form an ink dot on the recording paper sheet 5. A great number of such dots are arrayed to form an image or the like. The ejection head 25 includes a plurality of nozzles 35 (see FIG. 4), from which the ink is ejected, in a surface thereof that faces the recording paper sheet 5 (in this preferred embodiment, in a bottom surface 31*b* of the ejection head 25).

Figure 4:
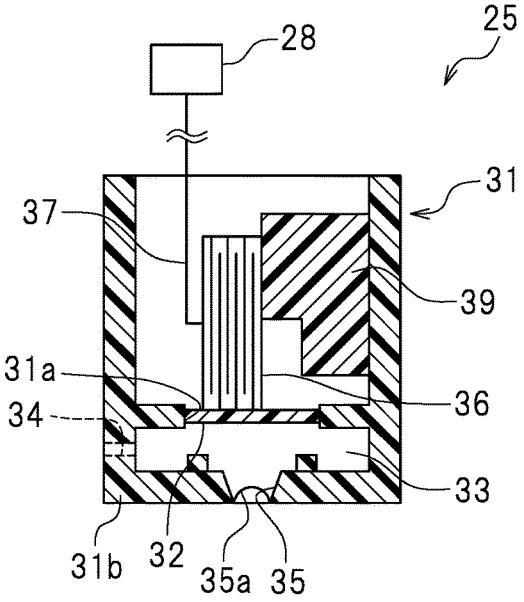
FIG. 4 is a partial cross-sectional view of an ejection head according to a preferred embodiment of the present invention.

FIG. 4 is a partial cross-sectional view of one nozzle 35 and the vicinity thereof of the ejection head 25. The ejection head 25 includes a hollow case 31 provided with an opening 31*a*, and a vibration plate 32 attached to the case 31 so as to close the opening 31*a*. In the case 31, a pressure chamber 33 storing ink is provided. The vibration plate 32 defines a portion of the pressure chamber 33. The vibration plate 32 is elastically deformable to the inside and the outside of the pressure chamber 33. The vibration plate 32 is deformable to increase or decrease the capacity of the pressure chamber 33. The vibration plate 32 is typically a resin film.

A side wall of the case 31 is provided with an ink inlet 34, which allows the ink to flow into the case 31. The ink inlet 34 merely needs to be in communication with the pressure chamber 33, and there is no limitation on the position of the ink inlet 34. The pressure chamber 33 is supplied with the ink from the ink cartridge 21 via the ink inlet 34, and temporarily stores the ink of a predetermined amount. The nozzle 35 is preferably provided in the bottom surface 31*b* of the case 31. The nozzle 35 is in communication with the pressure chamber 33. The nozzle 35 ejects a liquid drop (ink drop) toward the recording paper sheet 5. A liquid surface (free surface) in the nozzle 35 defines a meniscus 35*a*.

The pressure chamber 33 has a Helmholtz characteristic vibration period Tc. The Helmholtz characteristic vibration period is uniquely specified by the material, size, shape or location of each of components of the pressure chamber 33, for example, the case 31 and the vibration plate 32, the opening area size of the nozzle 35, properties (e.g., viscosity) of the ink, and the like. The Helmholtz characteristic vibration period Tc is a vibration period characteristic to the ejection head 25. The Helmholtz characteristic vibration period Tc is, for example, a vibration period of several microseconds to several ten microseconds. After an ink drop is ejected, the pressure chamber 33 has a residual vibration having such a vibration period.

A piezoelectric element 36 is coupled with a surface of the vibration plate 32 opposite to the pressure chamber 33. A portion of the piezoelectric element 36 is secured to a secured member 39 provided in the case 31. The piezoelectric element 36 is a type of actuator. The piezoelectric element 36 is connected with the controller 28 via a flexible cable 37. The piezoelectric element 36 is supplied with an electric signal via the flexible cable 37. In this preferred embodiment, the piezoelectric element 36 includes a stack body including a piezoelectric material layer and a conductive layer stacked alternately. The piezoelectric element 36 is extended or contracted upon receipt of a driving signal from the controller 28 and acts to elastically deform the vibration plate 32 to the inside or to the outside of the pressure chamber 33. In this example, the piezoelectric element 36 is a piezoelectric transducer (PZT) of a longitudinal vibration mode. The PZT of the longitudinal vibration mode is extendable in the stacking direction, and, for example, is contracted when being discharged and is extended when being charged. There is no specific limitation on the type of the piezoelectric element 36.

In the ejection head 25 having the above-described structure, the piezoelectric element 36 is contracted by, for example, a decrease in the potential thereof from a reference potential. When this occurs, the vibration plate 32 follows this contraction to be elastically deformed to the outside of the pressure chamber 33 from an initial position. Thus, the pressure chamber 33 is expanded. The expression that the "pressure chamber 33 is expanded" refers to that the capacity of the pressure chamber 33 is increased by the deformation of the vibration plate 32. Next, the potential of the piezoelectric element 36 is increased to extend the piezoelectric element 36 in the stacking direction. As a result, the vibration plate 32 is elastically deformed to the inside of the pressure chamber 33. Thus, the pressure chamber 33 is contracted. The expression that the "pressure chamber 33 is contracted" refers to that the capacity of the pressure chamber 33 is decreased by the deformation of the vibration plate 32. Such expansion/contraction of the pressure chamber 33 changes the pressure inside the pressure chamber 33. Such a change in the pressure inside the pressure chamber 33 pressurizes the ink in the pressure chamber 33, and the ink is ejected from the nozzle 35 as an ink drop. Then, the potential of the piezoelectric element 36 is returned to the reference potential, so that the vibration plate 32 returns to the initial position, and the pressure chamber 33 is expanded. At this point, ink flows into the pressure chamber 33 via the ink inlet 34.

The controller 28 is communicably connected with the carriage motor 18*a* of the carriage moving mechanism 18, the feed motor of the paper feeder, the supply pump 23, and the ejection head 25. The controller 28 is configured or programmed to control operations of these components. The controller 28 is typically a computer. The controller 28 includes, for example, an interface (I/F) receiving printing data or the like from an external device such as a host computer or the like, a central processing unit (CPU) executing a command of a control program, a ROM storing the program to be executed by the CPU, a RAM usable as a working area in which the program is developed, and a storage device such as a memory or the like storing the above-described program and various other types of data.

As shown in FIG. 3, the controller 28 includes a driving signal generation circuit 41 generating a main driving signal that drives the ejection heads 25, and a driving signal supply circuit 42 supplying a portion of, or the entirety of, the main driving signal generated by the driving signal generation circuit 41 to the piezoelectric element 36 in each of the ejection heads 25. In the following description, the piezoelectric element 36 in the ejection head 25 may be referred to as an "actuator 36". A signal supplied from the driving signal supply circuit 42 to the actuator 36 may be referred to as a "supply signal". As described below in detail, the supply signal is a signal including a portion of, or the entirety of, the main driving signal generated by the driving signal generation circuit 41.

There is no specific limitation on the hardware structure of the driving signal generation circuit 41 or the driving signal supply circuit 42. The hardware structure of each of the driving signal generation circuit 41 and the driving signal supply circuit 42 may be a known hardware structure (hardware structure disclosed in Japanese Laid-Open Patent Publication No. 2014-162221) and thus will not be described herein.

The main driving signal generated by the driving signal generation circuit 41 includes a plurality of driving pulses. In more detail, the main driving signal includes a first sub driving signal, a second sub driving signal and a third sub driving signal. The first sub driving signal, the second sub driving signal and the third sub driving signal each include one or at least two driving pulses. The driving signal supply circuit 42 selects one or at least two sub driving signals among the first through third sub driving signals, and supplies the selected sub driving signal(s) to the actuator 36. The driving signal supply circuit 42 appropriately selects the sub driving signal (s) to be supplied to the actuator 36, so that the amount of the ink to be ejected from the nozzles 35 of the ejection head 25 in one driving period is adjusted. Thus, the size of the dot of the ink formed on the recording paper sheet 5 is adjusted. The inkjet printer 10 in this preferred embodiment forms three different sizes of dots. In the following description, the three different sizes of dots will be referred to as a "first dot (small dot)", a "second dot (medium dot)" and a "third dot (large dot)" sequentially from the smallest dot.

As shown in FIG. 3, the driving signal supply circuit 42 includes a first dot generator 42*a*, a second dot generator 42*b*, and a third dot generator 42*c*. For the formation of the first dot, the first dot generator 42*a* supplies the actuator 36 with the first sub driving signal, which is a portion of the main driving signal, but supplies the actuator 36 with neither the second sub driving signal, which is another portion of the main driving signal, nor a third sub driving signal, which is still another portion of the main driving signal. For the formation of the second dot, the second dot generator 42*b* supplies the actuator 36 with the first sub driving signal and the second sub driving signal and but does not supply the actuator 36 with the third sub driving signal. For the formation of the third dot, the third dot generator 42*c* supplies the actuator 36 with the first sub driving signal, the second sub driving signal and the third sub driving signal.

Figure 5:
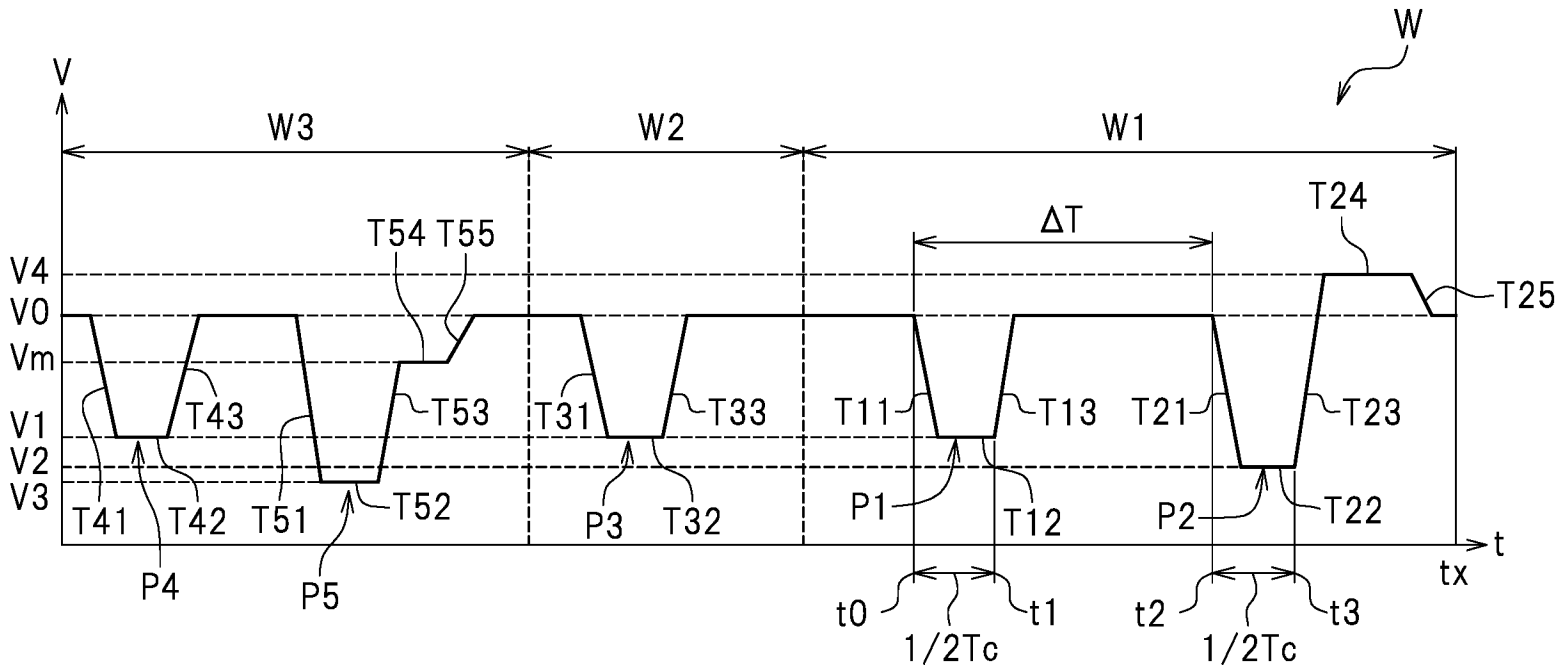
FIG. 5 is a waveform diagram of a main driving signal according to a preferred embodiment of the present invention.

FIG. 5 is a waveform diagram of a main driving signal W generated by the driving signal generation circuit 41. The horizontal axis t represents the time, and the vertical axis V represents the potential. tx represents one driving period. The driving signal generation circuit 41 generates the main driving signal W as shown in FIG. 5 in each driving period in repetition.

As shown in FIG. 5, the main driving signal W includes a first sub driving signal W1, a second sub driving signal W2 and a third sub driving signal W3. The first sub driving signal W1 is located in a rearmost portion of the main driving signal W. The second sub driving signal W2 is provided before the first sub driving signal W1. The third sub driving signal W3 is provided before the second sub driving signal W2. The third sub driving signal W3 may be located between the first sub driving signal W1 and the second sub driving signal W2.

The first sub driving signal W1 includes a first driving pulse P1 and a second driving pulse P2. The first driving pulse P1 is provided before the second driving pulse P2. The first driving pulse P1 includes a discharge waveform element T11 by which the potential of the actuator 36 is decreased from V0 to V1, a discharge maintaining waveform element T12 by which the potential of the actuator 36 is maintained at V1, and a charge waveform element T13 by which the potential of the actuator 36 is increased from V1 to V0. The second driving pulse P2 includes a discharge waveform element T21 by which the potential of the actuator 36 is decreased from V0 to V2, a discharge maintaining waveform element T22 by which the potential of the actuator 36 is maintained at V2, a charge waveform element T23 by which the potential of the actuator 36 is increased from V2 to V4, a charge maintaining waveform element T24 by which the potential of the actuator 36 is maintained at V4, and a discharge waveform element T25 by which the potential of the actuator 36 is decreased from V4 to V0.

The second sub driving signal W2 includes a third driving pulse P3. The third driving pulse P3 includes a discharge waveform element T31 by which the potential of the actuator 36 is decreased from V0 to V1, a discharge maintaining waveform element T32 by which the potential of the actuator 36 is maintained at V1, and a charge waveform element T33 by which the potential of the actuator 36 is increased from V1 to V0.

The third sub driving signal W3 includes a fourth driving pulse P4 and a fifth driving pulse P5. The fourth driving pulse P4 is provided before the fifth driving pulse P5. The fourth driving pulse P4 includes a discharge waveform element T41 by which the potential of the actuator 36 is decreased from V0 to V1, a discharge maintaining waveform element T42 by which the potential of the actuator 36 is maintained at V1, and a charge waveform element T43 by which the potential of the actuator 36 is increased from V1 to V0. The fifth driving pulse P5 includes a discharge waveform element T51 by which the potential of the actuator 36 is decreased from V0 to V3, a discharge maintaining waveform element T52 by which the potential of the actuator 36 is maintained at V3, a charge waveform element T53 by which the potential of the actuator 36 is increased from V3 to Vm, a charge maintaining waveform element T54 by which the potential of the actuator 36 is maintained at Vm, and a charge waveform element T55 by which the potential of the actuator 36 is increased from Vm to V0. In this preferred embodiment, V4>V0>Vm>V1>V2>V3. There is no specific limitation on the high/low relationship among Vm, V1, V2 and V3.

The first driving pulse P1, the second driving pulse P2, the third driving pulse P3, the fourth driving pulse P4 and the fifth driving pulse P5 are driving pulses that once increase and then decrease the capacity of the pressure chamber 33 (once expand and then contract the pressure chamber 33). In other words, the first through fifth pulses P1 through P5 are driving pulses that once decrease and then increase the pressure in the pressure chamber 33. The first through fifth pulses P1 through P5 are driving pulses respectively usable to eject first through fifth liquid drops.

Figure 6A:
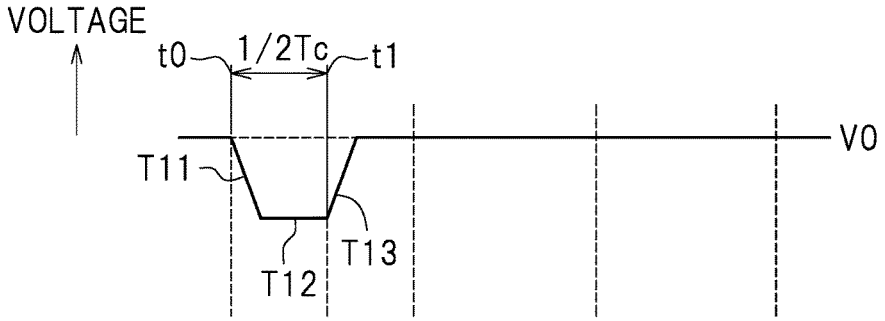
FIG. 6A shows a first driving pulse.
Figure 6B:
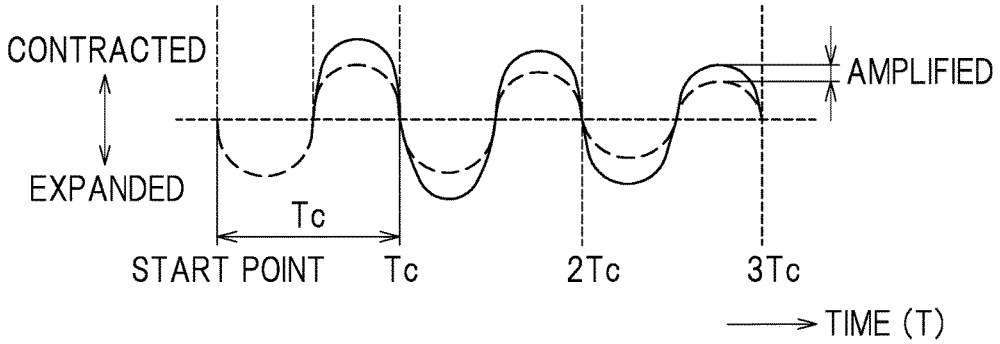
FIG. 6B shows a state of a pressure chamber corresponding to the first driving pulse shown in FIG. 6A.

In this preferred embodiment, a discharge time period (sum of the time period in which the actuator 36 is discharged and the time period in which the potential thereof is maintained at the discharge potential) of each of the first driving pulse P1 and the second driving pulse P2 is set to about ½ of the Helmholtz characteristic vibration period Tc of the ejection head 25. More specifically, where, as shown in FIG. 5, the time at which the discharge waveform element T11 starts is t0 and the time at which the discharge maintaining waveform element T12 finishes is t1, t0 and t1 are set to satisfy expression (1): $t1-t0=(1/2)\times Tc$. Where the time at which the discharge waveform element T21 starts is t2 and the time at which the discharge maintaining waveform element T22 finishes is t3, t2 and t3 are set to satisfy expression (2): $t3-t2=(1/2)\times Tc$. When the voltage value is decreased by the discharge as shown in FIG. 6A, the actuator 36 contracts; whereas when the voltage value is increased by the charge as shown in FIG. 6A, the actuator 36 extends. When the actuator 36 contracts, the pressure chamber 33 expands, whereas when the actuator 36 extends, the pressure chamber 33 contracts. Thus, t1−t0 in expression (1) and t3−t2 in expression (2) each represent the time period in which the pressure chamber 33 is maintained in an expanded state. The actuator 36 extends and contracts, which causes a Helmholtz characteristic vibration of the Helmholtz characteristic vibration period Tc as represented by the dashed line in FIG. 6B to the pressure chamber 33. The actuator 36 is switched from a contracted state to an extended state at the timing satisfying expression (1) or (2), so that the amplitude of the Helmholtz characteristic vibration of the pressure chamber 33 is increased as represented by the solid line in FIG. 6B. The pressure chamber 33 is expanded and contracted in synchronization with the Helmholtz characteristic vibration in this manner, so that the ink ejection is stabilized and a relatively large ink dot is ejected at a relatively low driving voltage. As a result, a large dot is formed on the recording paper sheet 5 with high precision.

In this preferred embodiment, timing ΔT at which the second driving pulse P2 starts after the start of the first driving pulse P1 is set to about p×Tc (p is an integer of 2 or greater). Namely, the second driving pulse P2 starts at the timing when the pressure chamber 33 vibrated at the Helmholtz characteristic vibration period Tc starts expanding. This prevents an operation of cancelling the vibration of the pressure chamber 33 expanding at the Helmholtz characteristic vibration period Tc, and thus the ejection stability is improved. As a result, a dot having a stable size is formed at a predetermined position on the recording paper sheet 5. In this specification, "p×Tc" encompasses a value exactly matching p×Tc theoretically and also a value with fluctuation, an error or the like of Tc. For example, p×Tc may be a value in the theoretical range of p×Tc−(⅛)×Tc to p×Tc+(⅛)×Tc, and preferably a value in the theoretical range of p×Tc−(1/10)×Tc to p×Tc+(1/10)×Tc.

Figure 6C:
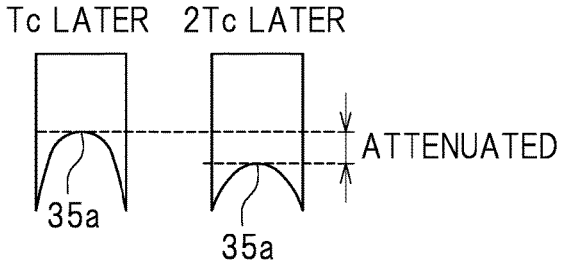
FIG. 6C shows a state of a meniscus in the vicinity of a nozzle.

Now, an effect provided by setting the timing when the second driving pulse P2 starts to 2Tc after the start of the first driving pulse P1, namely, setting the value of p to p≥2, will be described. After the first liquid drop is ejected, there is a residual pressure change of the actuator 36 in the pressure chamber 33. Therefore, the meniscus 35*a* of the nozzle 35 is in a state of significantly pulled into the pressure chamber 33. The meniscus 35*a* is continuously recovered toward the opening of the nozzle 35 along time, and the amount by which the meniscus 35*a* is pulled is gradually decreased. If the second driving pulse P2 starts when a time period of Tc lapses after the start of the first driving pulse P1 as shown in FIG. 6C, namely, in a state where the meniscus 35*a* is significantly pulled into the pressure chamber 33, the time period after the ejection of the first liquid drop until the start of the ejection of the second liquid drop is short. Therefore, a so-called pulling ejection is generated, and the amount of the second liquid drop is small. In addition, the resistance of the flow path in vicinity of the nozzle 35 is increased, and thus the speed of satellite drops is easily decreased after the second liquid drop is ejected. As a result, mist is easily generated.

In the case where the second driving pulse P2 starts when a time period of 2Tc lapses after the start of the first driving pulse P1 (i.e., p≥2), the second liquid drop is ejected in a state where the meniscus 35*a* is recovered toward the opening of the nozzle 35 to at least a predetermined degree. Therefore, as compared with the case where the second driving pulse P2 starts when a time period of Tc lapses after the start of the first driving pulse P1, the amount of the second liquid drop is larger. In addition, the interval between the first driving pulse P1 and the second driving pulse P2 is extended. Therefore, the Helmholtz characteristic vibration of the Helmholtz characteristic vibration period Tc caused in the pressure chamber 33, which has been increased by the first driving pulse P1, is gradually decreased. Therefore, the degree of contraction of the pressure chamber 33 is decreased, and the amount of ink passing the nozzle 35 per unit time is decreased. As a result, the resistance of the flow path in the vicinity of the nozzle 35 is decreased, and thus the speed of the satellite drops is increased. This suppresses or prevents generation of the long satellite drops or the mist, and allows the second liquid drop to be stably ejected with an amount larger than, or equal to, that of the first liquid drop. In the case of, for example, a large-scale printer for industrial use as shown in FIG. 1, the value of p may be generally about 10 or less, typically about 7 or less, preferably about 5 or less, more preferably about 3 or less, and especially preferably 2.

In this preferred embodiment, the second liquid drop (second ink drop) ejected by the second driving pulse P2 is preferably set to be ejected at a speed higher than, or equal to, that of the first liquid drop (first ink drop) ejected by the first driving pulse P1. Namely, the change amount in the potential of the charge waveform element T23 of the second driving pulse P2 (i.e., V4−V2) is preferably set to be larger than the change amount in the potential of the charge waveform element T13 of the first driving pulse P1 (i.e., V0−V1). With such an arrangement, the first liquid drop and the second liquid drop are merged appropriately before arriving at the recording paper sheet 5 (in other words, while being in the air). The above-described arrangement also better reduces or prevents generation of the long satellite drops or mist.

Figure 7:
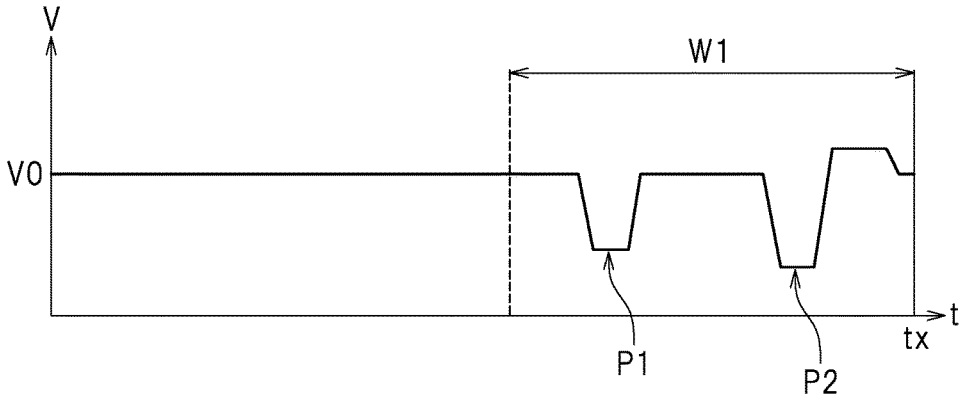
FIG. 7 is a waveform diagram of a supply signal supplied to form a small dot.

FIG. 7 shows a supply signal supplied to the actuator 36 to form the first dot (small dot). When the actuator 36 is supplied with the first driving pulse P1, the capacity of the pressure chamber 33 is once increased and then decreased, and an operation of ejecting the first liquid drop from the nozzle 35 is performed once. Next, when the actuator 36 is supplied with the second driving pulse P2, the capacity of the pressure chamber 33 is, again, once increased and then decreased, and an operation of ejecting the second liquid drop from the nozzle 35 is performed once. Namely, when the actuator 36 is supplied with the first driving pulse P1 and the second driving pulse P2, the operation of ejecting each of the first liquid drop and the second liquid drop from the nozzle 35 is performed. The first liquid drop and the second liquid drop are merged before arriving at the recording paper sheet 5.

Figure 8:
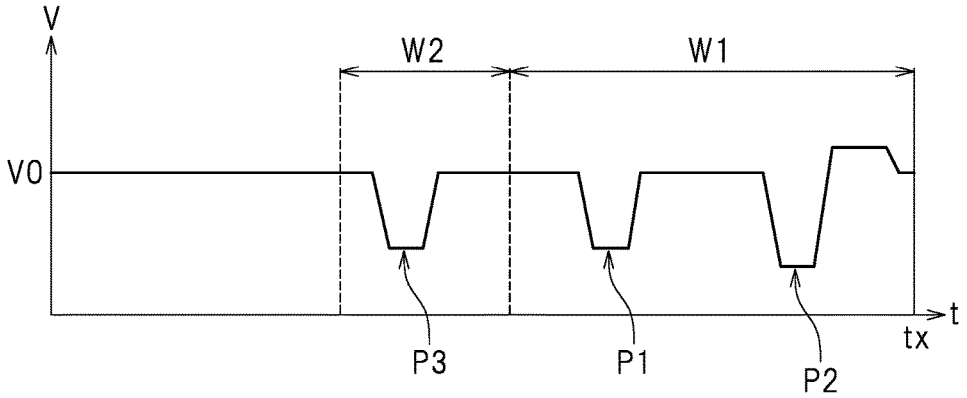
FIG. 8 is a waveform diagram of a supply signal supplied to form a medium dot.

FIG. 8 shows a supply signal supplied to the actuator 36 to form the second dot (medium dot). When the actuator 36 is supplied with the third driving pulse P3, the capacity of the pressure chamber 33 is once increased and then decreased, and an operation of ejecting the third liquid drop from the nozzle 35 is performed once. Next, when the actuator 36 is supplied with the first driving pulse P1 and the second driving pulse P2, the capacity of the pressure chamber 33 is, again, once increased and then decreased, and an operation of ejecting each of the first liquid drop and the second liquid drop from the nozzle 35 is performed once. Namely, when the actuator 36 is supplied with the first through third driving pulses P1 through P3, the operation of ejecting each of the first through third liquid drops from the nozzle 35 is performed. The first through third liquid drops are merged before arriving at the recording paper sheet 5.

Figure 9:
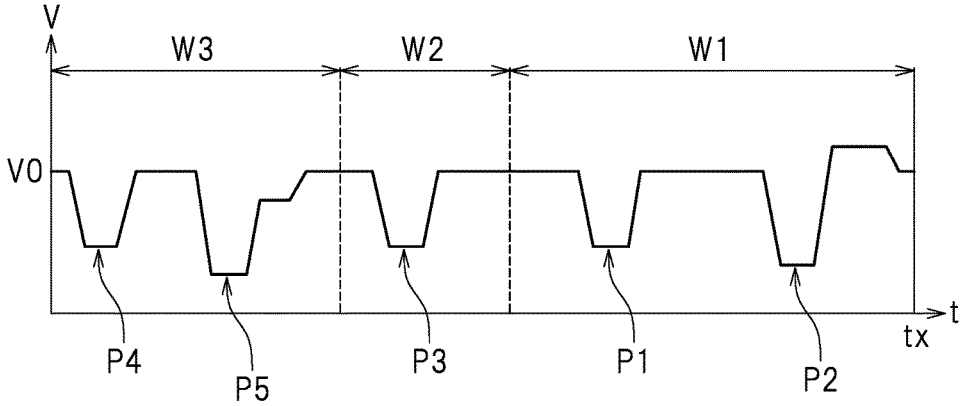
FIG. 9 is a waveform diagram of a supply signal supplied to form a large dot.

FIG. 9 shows a supply signal supplied to the actuator 36 to form the third dot (large dot). When the actuator 36 is supplied with the fourth driving pulse P4, the capacity of the pressure chamber 33 is once increased and then decreased, and an operation of ejecting the fourth liquid drop from the nozzle 35 is performed once. Next, when the actuator 36 is supplied with the fifth driving pulse P5, the capacity of the pressure chamber 33 is, again, once increased and then decreased, and an operation of ejecting the fifth liquid drop from the nozzle 35 is performed once. Next, when the actuator 36 is supplied with the third driving pulse P3, the first driving pulse P1 and the second driving pulse P2, the capacity of the pressure chamber 33 is, again, once increased and then decreased, and an operation of ejecting each of the third liquid drop, the first liquid drop and the second liquid drop from the nozzle 35 is performed once. Namely, when the actuator 36 is supplied with the first through fifth driving pulses P1 through P5, the operation of ejecting each of the first through fifth liquid drops from the nozzle 35 is performed. The first through fifth liquid drops are merged before arriving at the recording paper sheet 5.

In this manner, in order to form the first dot, the second dot and the third dot, the inkjet printer 10 commonly uses the first sub driving signal W1 (i.e., first driving pulse P1 and the second driving pulse P2) located in the rearmost portion of the main driving signal W. Therefore, when the first dot, the second dot or the third dot is formed by a specific nozzle 35 in the ejection head 25, the pressure change that may be caused to the specific nozzle 35 is constant. As a result, the pressure change that may be caused to a nozzle 35 adjacent to the specific nozzle 35 and the pressure change that may be caused to the pressure chamber 33 in communication with the nozzles 35 are also constant. Thus, the nozzle characteristics are alleviated from being varied among the plurality of the nozzles 35.

As described above, the liquid ejection device 20 in this preferred embodiment uses the first sub driving signal W1 of the main driving signal W commonly to form the first dot and to form the second dot. Since the second sub driving signal W2 is provided before the first sub driving signal W1, the first driving pulse P1 and the second driving pulse P2, which are driving pulses in a final portion of the main driving signal W to be supplied to each of the actuators 36, are commonly used to form the first dot and to form the second dot. Therefore, regardless of which size of dot is formed by the adjacent nozzle 35, the driving timing of the second driving pulse P2, which is the final driving pulse of the first sub driving signal W1, is the same among the nozzles 35. (The "driving timing" is the time from the start to the finish of the driving pulse.) As a result, regardless of the size of the dot formed by the nozzles 35, a constant pressure change is caused to the pressure chamber 33. Therefore, the nozzle characteristics are alleviated from being varied among the plurality of nozzles 35, and a desired size of liquid drop is ejected stably from each of the nozzles 35.

In the liquid ejection device 20 in this preferred embodiment, the pressure chamber 33 is switched from the expanded state to the contracted state at the timing of (½)×Tc while the first driving pulse P1 and the second driving pulse P2 are applied. With such an arrangement, the first driving pulse P1 and the second driving pulse P2 act to amplify the Helmholtz characteristic vibration of the Helmholtz characteristic vibration period Tc caused in the pressure chamber 33. As a result, the liquid drop ejection stability is improved, and the amount of expansion and contraction of the pressure chamber 33 is increased to eject a larger liquid drop. In the liquid ejection device 20, the second driving pulse P2 starts when the p×Tc (p≥2) lapses after the start of the first driving pulse P1. With such an arrangement, the amount by which the meniscus 35*a* is pulled after the first liquid drop is ejected is appropriately decreased, and thus a large second liquid drop with a large liquid amount is ejected stably. In the liquid ejection device 20, the second liquid drop is ejected at a speed higher than, or equal to, that of the first liquid drop. Therefore, the first liquid drop and the second liquid drop are appropriately merged. Since the ejection speed of the second liquid drop is increased, generation of the long satellite drops or mist is highly reduced or prevented.

In the liquid ejection device 20 in this preferred embodiment, the timing ΔT at which the second driving pulse P2 starts after the start of the first driving pulse P1 is set to be p×Tc (p is an integer of 2 or greater: preferably p=2 through 5, especially preferably p=2). This increases the printing speed and improves the throughput. In addition, a certain level of ejection speed of ink is guaranteed, and thus the ejection is more stabilized.

In the liquid device 20 in this preferred embodiment, the first sub driving signal W1 of the main driving signal W is commonly used to form the first dot, to form the second dot and to form the third dot. Since the second sub driving signal W2 and the third sub driving signal W3 are provided before the first sub driving signal W1, the first driving pulse P1 and the second driving pulse P2, which are driving pulses in a final portion of the main driving signal W to be supplied to each of the actuators 36, are commonly used to form the first dot, to form the second dot and to form the third dot. Therefore, regardless of which size of dot is formed by the adjacent nozzle 35, the driving timing of the second driving pulse P2 a driving timing of the second driving pulse P2, which is the final driving pulse of the first sub driving signal W1, is the same among the nozzles 35. As a result, regardless of the size of the dot formed by the nozzles 35, a constant pressure change is caused to the pressure chamber 33. Therefore, the nozzle characteristics are prevented from being varied among the plurality of the nozzles 35, and a desired size of liquid drop is ejected stably from each of the nozzles 35.

In the liquid ejection device 20 in this preferred embodiment, the third sub driving signal W3 is provided before the second sub driving signal W2. As the amount of the liquid ejected from the nozzle 35 is larger, the ejection speed of the liquid tends to be higher. Therefore, for forming the medium dot, the liquid ejected by the supply of the first sub driving signal W1 is certainly merged with the liquid ejected by the supply of the second sub driving signal W2.

In the liquid ejection device 20 in this preferred embodiment, the second sub driving signal W2 includes the third driving pulse P3, and the third sub driving signal W3 includes the fourth driving pulse P4 and the fifth driving pulse P5. With such an arrangement, a desired size of liquid drop is ejected from each of the nozzles 35 stably.

Some preferred embodiments of the present invention have been described so far. The above-described preferred embodiments are merely examples, and the present invention may be carried out in any of various other preferred embodiments.

In the above-described preferred embodiments, the actuator 36 is a piezoelectric element of a longitudinal vibration mode. The actuator 36 is not limited to this. The actuator 36 may be a piezoelectric element of a lateral vibration mode. The actuator 36 is not limited to a piezoelectric element, and may be, for example, a magnetostrictive element or the like.

In the above-described preferred embodiments, the liquid is ink. The liquid is not limited to this. The liquid ejection device 20 may be, for example, a resin material, any of various liquid compositions containing a solute and a solvent (e.g., washing liquid), or the like.

In the above-described preferred embodiments, the ejection head is the ejection head 25 included in the inkjet printer 10. The ejection head is not limited to this. The ejection head may be mountable on, for example, any of various production devices of an inkjet system, a measuring device such as a micropipette, or the like, to be usable in any of various uses.

In the above-described preferred embodiments, the first sub driving signal W1 includes two driving pulses, the second sub driving signal W2 includes one driving pulse, and the third sub driving signal W3 includes two driving pulses. The sub driving signals are not limited to having such a structure. The first sub driving signal W1 may include one or at least three driving pulses, the second sub driving signal W2 may include at least two driving pulses, and the third sub driving signal W3 may include one or at least three driving pulses.

In the above-described preferred embodiments, the main driving signal W includes the first sub driving signal W1, the second sub driving signal W2 and the third sub driving signal W3. The main driving signal W is not limited to having such a structure. The main driving signal W may include two sub driving signals or at least four sub driving signals.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principle of the present invention. These preferred embodiments are provided with the understanding that they are not intended to limit the present invention to the preferred embodiments described in the specification and/or shown in the drawings. The present invention is not limited to the preferred embodiment described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or used during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A liquid ejection device, comprising:

a liquid ejection head that ejects a liquid; and a controller that controls the liquid ejection head;

wherein:

the liquid ejection head includes:

a case that includes a pressure chamber provided therein, the pressure chamber storing a liquid;

a vibration plate provided in the case, the vibration plate defining a portion of the pressure chamber;

an actuator coupled with the vibration plate, the actuator being deformed when supplied with an electric signal; and a nozzle provided in the case and in communication with the pressure chamber;

the controller includes:

a driving signal generation circuit that generates a main driving signal that includes, in each of driving periods, at least a first sub driving signal and a second sub driving signal, the first sub driving signal including one or at least two driving pulses, and the second sub driving signal including one or at least two driving pulses and provided before the first sub driving signal; and a driving signal supply circuit that supplies the actuator with a portion of, or an entirety of, the main driving signal generated by the driving signal generation circuit;

the driving signal supply circuit includes:

a first dot generator that supplies the actuator with the first sub driving signal but does not supply the actuator with the second sub driving signal; and a second dot generator that supplies the actuator with the first sub driving signal and the second sub driving signal;

the first sub driving signal includes a first driving pulse usable to expand and contract the pressure chamber to eject a first liquid drop, and a second driving pulse usable to expand and contract the pressure chamber to eject a second liquid drop; and Tc is a Helmholtz characteristic vibration period of the ejection head;

the first driving pulse keeps the pressure chamber expanded for a time period of $(1/2)\times Tc$; and the second driving pulse starts when a time period of $p\times Tc$, where p is an integer of 2 or greater, lapses after the first driving pulse starts, to keep the pressure chamber expanded for the time period of $(1/2)\times Tc$, and to eject the second liquid drop at a speed higher than, or equal to, that of the first liquid drop.

2. The liquid ejection device according to claim 1, wherein p is 2.

3. The liquid ejection device according to claim 1, wherein the main driving signal further includes a third sub driving signal that includes one or at least two driving pulses and is provided before the first sub driving signal; and the driving signal supply circuit further includes a third dot generator that supplies the actuator with the first sub driving signal, the second sub driving signal and the third sub driving signal.

4. A liquid ejection device, comprising:

a liquid ejection head that ejects a liquid; and a controller that controls the liquid ejection head;

wherein:

the liquid ejection head includes:

a case that includes a pressure chamber provided therein, the pressure chamber storing a liquid;

a vibration plate provided in the case, the vibration plate defining a portion of the pressure chamber;

an actuator coupled with the vibration plate, the actuator being deformed when supplied with an electric signal; and a nozzle provided in the case and in communication with the pressure chamber;

the controller includes:

a driving signal generation circuit that generates a main driving signal that includes, in each of driving periods, at least a first sub driving signal, a second sub driving signal, and a third sub driving signal, the first sub driving signal including one or at least two driving pulses, the second sub driving signal including one or at least two driving pulses and provided before the first sub driving signal, and the third sub driving signal including one or at least two driving pulses and provided before the second sub driving signal; and a driving signal supply circuit that supplies the actuator with a portion of, or an entirety of, the main driving signal generated by the driving signal generation circuit; and the driving signal supply circuit includes:

a first dot generator that supplies the actuator with the first sub driving signal but does not supply the actuator with the second sub driving signal;

a second dot generator that supplies the actuator with the first sub driving signal and the second sub driving signal; and a third dot generator that supplies the actuator with the first sub driving signal, the second sub driving signal and the third sub driving signal.

5. The liquid ejection device according to claim 3, wherein:

the second sub driving signal includes a third driving pulse usable to expand and contract the pressure chamber to eject a third liquid drop; and the third sub driving signal includes a fourth driving pulse usable to expand and contract the pressure chamber to eject a fourth liquid drop, and a fifth driving pulse usable to expand and contract the pressure chamber to eject a fifth liquid drop.

6. An inkjet printer, comprising:

the liquid ejection device according to claim 1; wherein the liquid is ink.

* * * * *